United States Patent [19]

Dragonuk, deceased et al.

[11] Patent Number: 5,054,364

[45] Date of Patent: Oct. 8, 1991

[54] MULTI-SONOBUOY LAUNCH CONTAINER WITH MECHANICAL ACTUATOR

[75] Inventors: Leo Dragonuk, deceased, late of Plymouth Meeting, Pa.; By Elana D. Randall, executrix, West Chester; N. Paige Kilkenny, executrix, Haverford, both of Pa.

[73] Assignee: The United States of America as represented by the Secretary of the Navy, Washington, D.C.

[21] Appl. No.: 554,324

[22] Filed: Jul. 18, 1990

[51] Int. Cl.[5] ..... B64D 1/04

[52] U.S. Cl. ..... 89/1.51; 244/137.1

[58] Field of Search ..... 89/1.51, 1.57, 1.81; 102/338, 340, 342, 351, 357, 438, 505; 244/137.1

[56] References Cited

U.S. PATENT DOCUMENTS

| | | | |
|---|---|---|---|
| 2,608,131 | 8/1952 | Pearce | 89/1.51 |
| 2,707,904 | 5/1955 | Strunk et al. | 89/1.51 |
| 3,618,450 | 11/1971 | Fink et al. | 89/1.51 |
| 3,787,012 | 1/1974 | Jakobowski | 89/1.51 |
| 4,164,887 | 8/1979 | Ovellette | 89/1.51 |
| 4,397,433 | 8/1983 | Guitaut et al. | 89/1.51 |
| 4,444,085 | 4/1984 | Dragonuk | 89/1.51 |

*Primary Examiner*—Stephen C. Bentley

*Attorney, Agent, or Firm*—James V. Tura; James B. Bechtel; Susan E. Verona

[57] ABSTRACT

A multi-store launch container is disclosed wherein a plurality of stores, maintained in a tandem configuration therein, can be sequentially ejected. The container is normally carried by a vehicle and receives the necessary charges, of for instance pressurized gas, at its breach end. A spring-biased cocking mechanism forces open a first port cover and maintains a second port cover in the closed position. After the first charge is fired, the cocking mechanism allows the port covers to pivot and the first port is now tightly shut and the second port open for the next charge.

8 Claims, 6 Drawing Sheets

MULTI-SONOBUOY LAUNCH CONTAINER WITH MECHANICAL ACTUATOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention discloses a fluid-actuated, multi-store dispenser wherein a spring-biased mechanical linkage causes sequential launching of stores from their tandem position inside a launch container. In some environments, it is desirable to dispense multiple stores from a launch vehicle, for instance sonobuoys, in dense patterns. Due to physical limitations of space in the dispensing vehicle, an effort was made to miniaturize the active components inside the store and therefore reduce the overall outer dimensions thereof. Once the size of the store was reduced, in order to meet the demands of the denser patterns, the inside of the individual launch containers were modified to allow each to hold and dispense more than one store. Any new type of launch container, in addition to maintaining the size requirement dictated by the transporting vehicle, must be operated by the vehicle's pneumatic gas and electrical systems.

SUMMARY OF THE INVENTION

It is therefore an object of the present invention to develop an internal mechanism that will allow the carriage and dispensing of a plurality of stores from within a single launch container.

It is a further object of the invention to develop such an internal mechanism that can easily be retrofitted into the existing inventory of launch containers.

It is a still further object of the present invention to develop an internal mechanism that will permit the carriage and dispensing of a plurality of stores from within a single container without interfering with the safety o the reliability of either the dispensing vehicle or the container.

It is a still further object of the present invention to develop such a internal mechanism that will be relatively simple to manufacture, install and maintain.

These and other objects of the invention are accomplished by a tubular store launch container, that is installed in a vehicle to receive a fluid charge into its breech end, that contains a biased mechanical linkage, two fluid ports for directing the fluid charge and a twin-seated valve cover that alternatingly opens for one port and then the other. The stores are loaded into the container in tandem positions and the inner end of the last to be loaded forces against the bottom part of spring-loaded cocking mechanism. The store is temporarily sealed into the container to cause the upper end of the cocking mechanism to sit inside a channel and force one half of a spring-biased flapper valve away from a first port and the second half over the second port. At a predetermined signal, a first charge of gas flows into the first port, down the channel and impacts against the inner end of the last-loaded store. The pressure forces the store out of the container thereby removing the resistance to the flapper valve. The first half of the valve is spring-force closed over the first port, allowing the second half to open up the second port. Whenever the vehicle is ready to dispense the second store, a second charge will now flow against the inner surface thereof to force it from the container.

DETAILED DESCRIPTION OF THE PREFERRED EMBODIMENT

Figure 1:
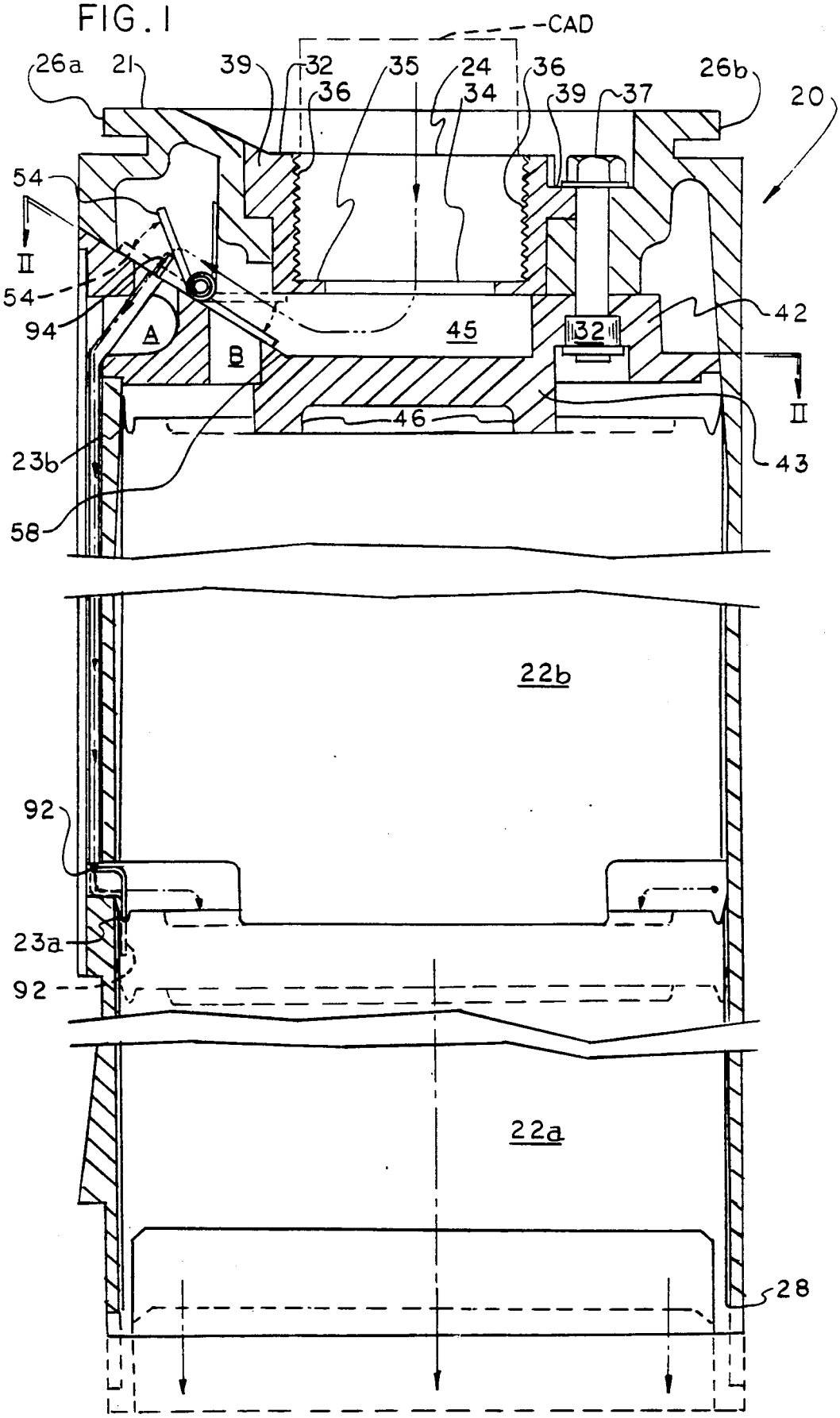
FIG. 1 shows a cross-sectional elevation view of a launch container, modified by the instant invention, with two stores contained therein and after a first charge has been fired.
Figure 2:
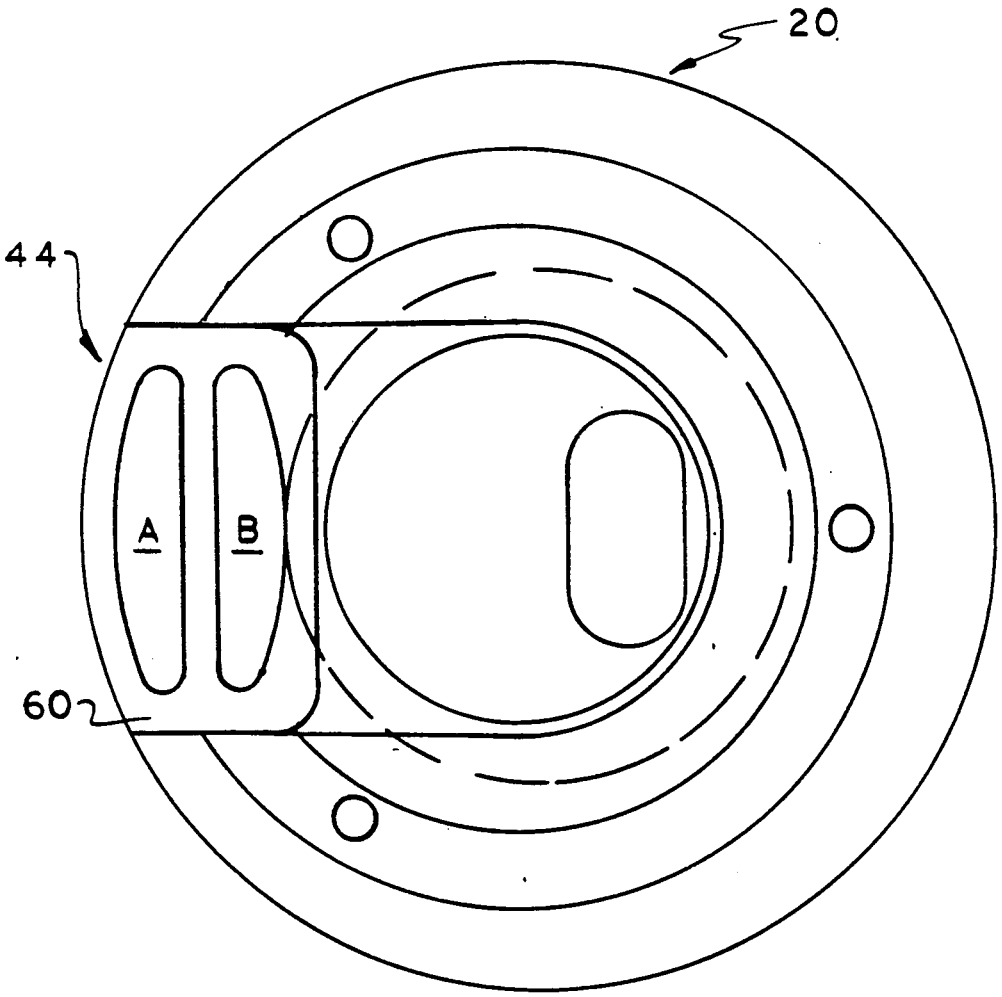
FIG. 2 shows a cross-sectional view, taken along lines II—II of FIG. 1, showing a view of the upper, inside of the breach end of the launch container when the flapper valve assembly has been removed.

Referring now to the drawings wherein like characters designate like or corresponding parts throughout the several views, there is shown in FIG. 1, a cross-sectional elevation view of a standard-size launch container 20, connected into the transporting vehicle (not shown in FIG. 1), with two stores *22a*, *22b* contained therein and after a first fluid charge (denoted by the fluid flow dashed arrows) has been fired, as for instance from a multi-charge cartridge-activated device (CAD) (shown in phantom). The charge can be either a pneumatic gas charge, such as is detailed in U.S. Pat. No. 4,444,085 which is incorporated herein by reference, or an explosive charge from what is commonly called a cartridge-activated-device, or CAD, as is known in the art. Launch container 20 is connected to the transport vehicle at its breach end 24 by locking lugs *26a*, *26b* being inserted into receptacles (not shown) in the vehicle, as is known, to thereby leave its discharge end 28 open to the environment. Launch container 20 can be made from molded ABS plastic or aluminum sheet, formed into a tubular sleeve of predetermined diameter and length, with the components at the breach end, as will be more fully described below, being made from molded plastic or other suitable materials. FIG. 2 shows a sectional view of launch container 20 taken along lines II—II of FIG. 1, showing container 20 with the breach end cap 21 removed.

A plenum chamber 32 to receive fluid charges, in the form of a cup, with a fluid charge aperture 34 through the central portion of the bottom 35, is affixed inside the breach end 24 of cap 21, as by one or more fasteners 37. The charge supplying mechanism (such as, for instance, a CAD, as shown in phantom) can be conveniently attached thereto, as by mating threads therefrom to the threads 36 on the inner surface of the chamber walls. Fasteners 37, for instance a bolt and nut combination shown in FIG. 1, fix the side tab 39 of chamber 32 to cap 21 and to charge collection chamber housing 42. Chamber housing 42 is rigidly secured, near the breach end, to the inside of container 20, as shown, and consists of a centrally located alignment disc 43, a radially-located securing section to capture fastener 37 and the port section 44, also located along the circumference of container 20. Alignment disc 43, by its proximal surface, provides the resistance necessary to divert the charges, and by the ring 46 on its distil surface, provides a charge-deflecting guide to properly direct the charge around the outer perimeter of the innermost store to bring the firing force to bear evenly on the store as it is discharged from container 20. Each store 22*b*, 22*a* is inserted inside container 20 so that its upper rim 23*b*, 23*c*, respectively, forms a hermetic seal, to be broken only when sufficient charge pressure accumulates, between the inner surface of the walls of container 20 and the rim. If desired, a disc of foam padding can be inserted atop each store (not shown) to prevent damage to the top surface thereof while the store is being carried in container 20. Charge collection chamber 45, situated immediately below plenum chamber 32, collects and diverts the charge to different ports, such as port A or port B, as will be described.

Figure 4:
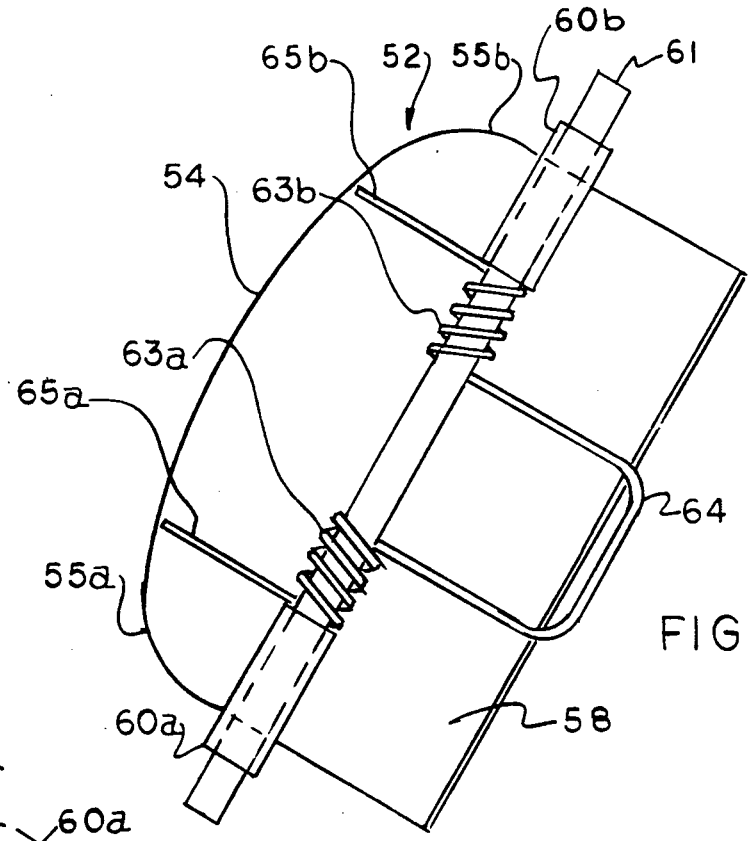
FIG. 4 shows a plan view of the flapper valve shown in FIG. 3.
Figure 3:
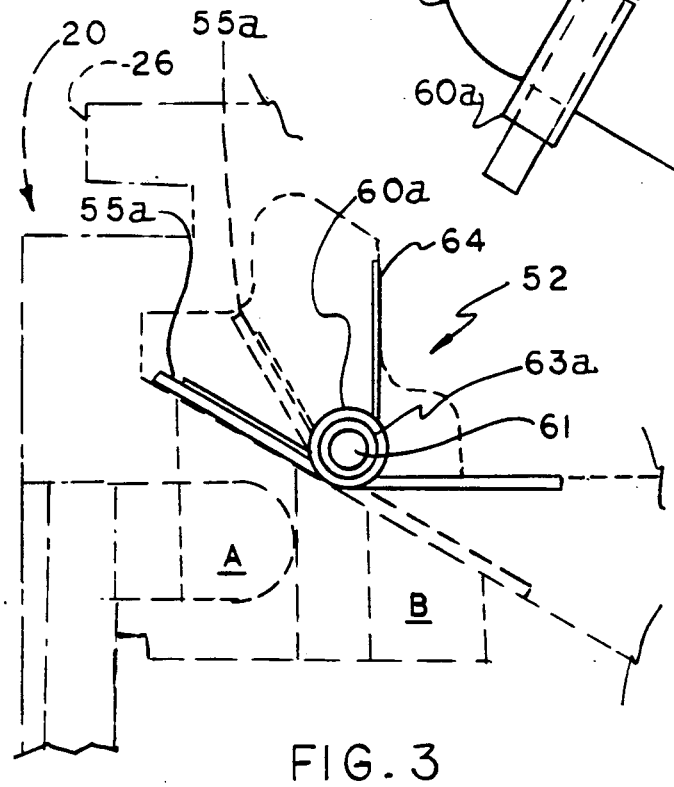
FIG. 3 shows an isolated and enlarged view of the flapper valve shown in FIG. 1.

Two of the key components of the present invention are the flapper valve assembly 50 and the action mechanism 80, both shown in FIG. 1 in their initial positions and (in phantom) in their reaction positions. Flapper valve assembly 50 is comprised of spring-loaded flapper valve 52, as shown in enlarged isolated and plan views in FIGS. 3 and 4, and the housing 60 for twin ports A and B, shown more clearly in FIG. 2. Valve 52 is comprised of a formerly flat, rectangular section of material that has two rounded corners 55*a*, 55*b* such that, on the one half 54, their contour conforms to the semiovular shape of the outer periphery of port A and on the opposite half 58, the squared-off corners cover the entire area of the opening of port B. Half 54 of the section is angled to approximately thirty degrees from the horizontal, thus forming an axis of oscillation at approximately midway between opposing edges, so that when valve 52 is set onto the island 58 between ports A and B, either one or the other, but not both, halves will seal off either port A or B as valve 52 is rocked back and forth, as will be explained. A pair of tubular members 60*a*, 60*b* are fixed along the axis and a pair of negator springs 63*a*, 63*b* positioned thereon by a bar 61 placed through the tubular pivots. Valve 52 is set over ports A and B with connecting hook 64 forced against the inner wall of cap 21, as shown, so that spring extensions 65*a*, 65*b* force half 54 to sealingly cover port A and leave an opening to port B.

Figure 5:
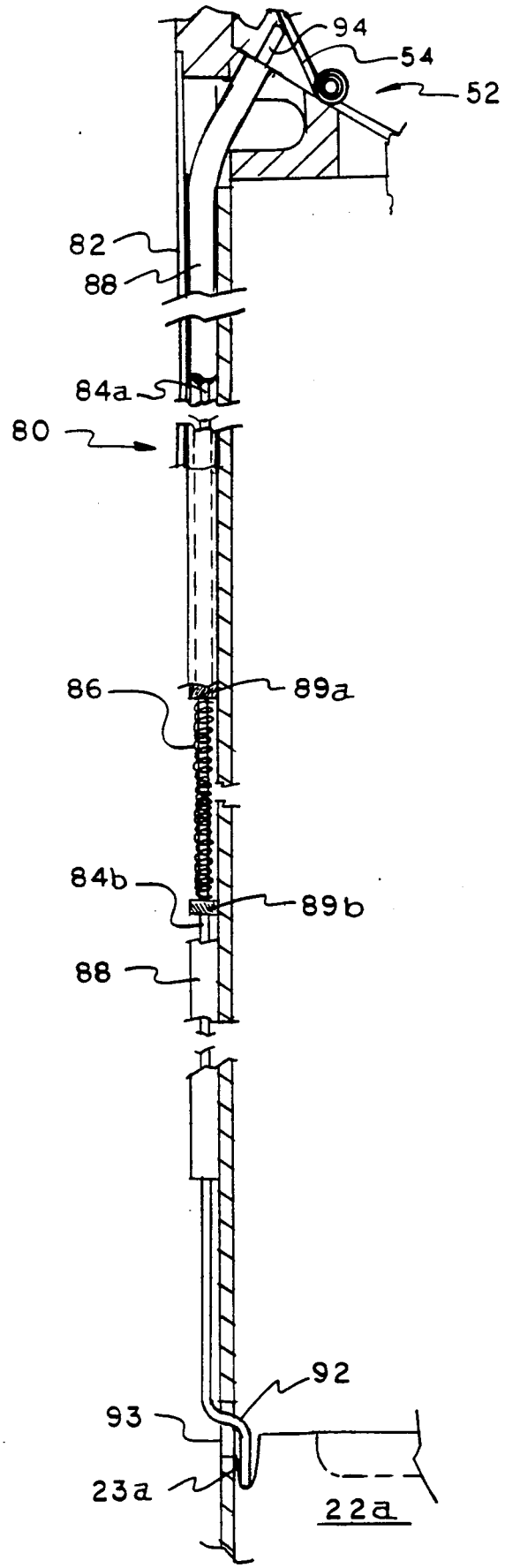
FIG. 5 shows an enlarged and isolated elevation view of the action mechanism of FIG. 1.

Action mechanism 80, as more clearly seen in the isolated view of FIG. 5, is set into the narrow, radially-extending cavity directly under port A for a substantial length along container 20. Once mechanism 80 is set in place, a cavity cover 82 (shown partially cut-away in FIG. 5) is securely fastened to the container making the cavity airtight. Mechanism 80 consists of a two-piece flexible cable 84*a*, 84*b*, that acts as a force transferring means, as will be explained, and is joined at a midpoint by a coiled spring 86, and inserted substantially inside a tube 88, which tube is permanently fixed to its location in the cavity. Spring 86 is fixed to upper and lower sections 84*a*, 84*b*, respectively, by circular clamps 89*a*, 89*b*, as is known. The end section of tube 88 nearest the breach end of container 20 is bent slightly, at an angle of approximately forty-five degrees, to be positioned from the cavity inside cap 21. The distil end of cable 84*b* is fashioned into an elongated "S"-shaped probe 92, or sensing means, that is inserted through a slot 93 at a predetermined location in the container sidewall. As will be explained, when store 22*a* is loaded into container 20, probe 92 is caught by rim 23*a* and inward loading force exerted on store 22*a* moves probe 92, and cable 84, toward the breach end.

Figure 6:
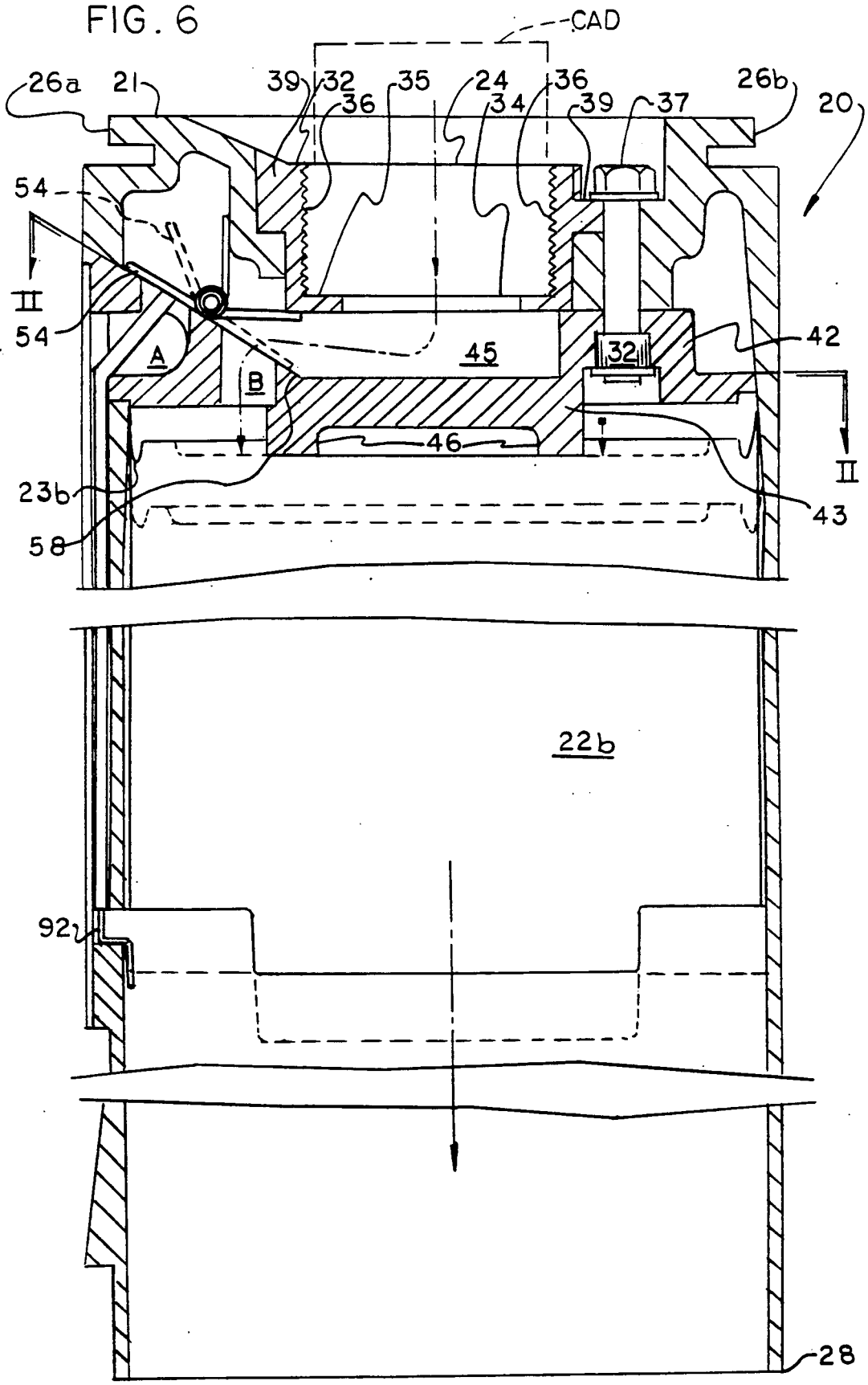
FIG. 6 shows a cross-sectional elevation view, similar to FIG. 1, after one store has been ejected and depicting a second charge (shown by the dashed arrow) firing the innermost store.
Figure 7:
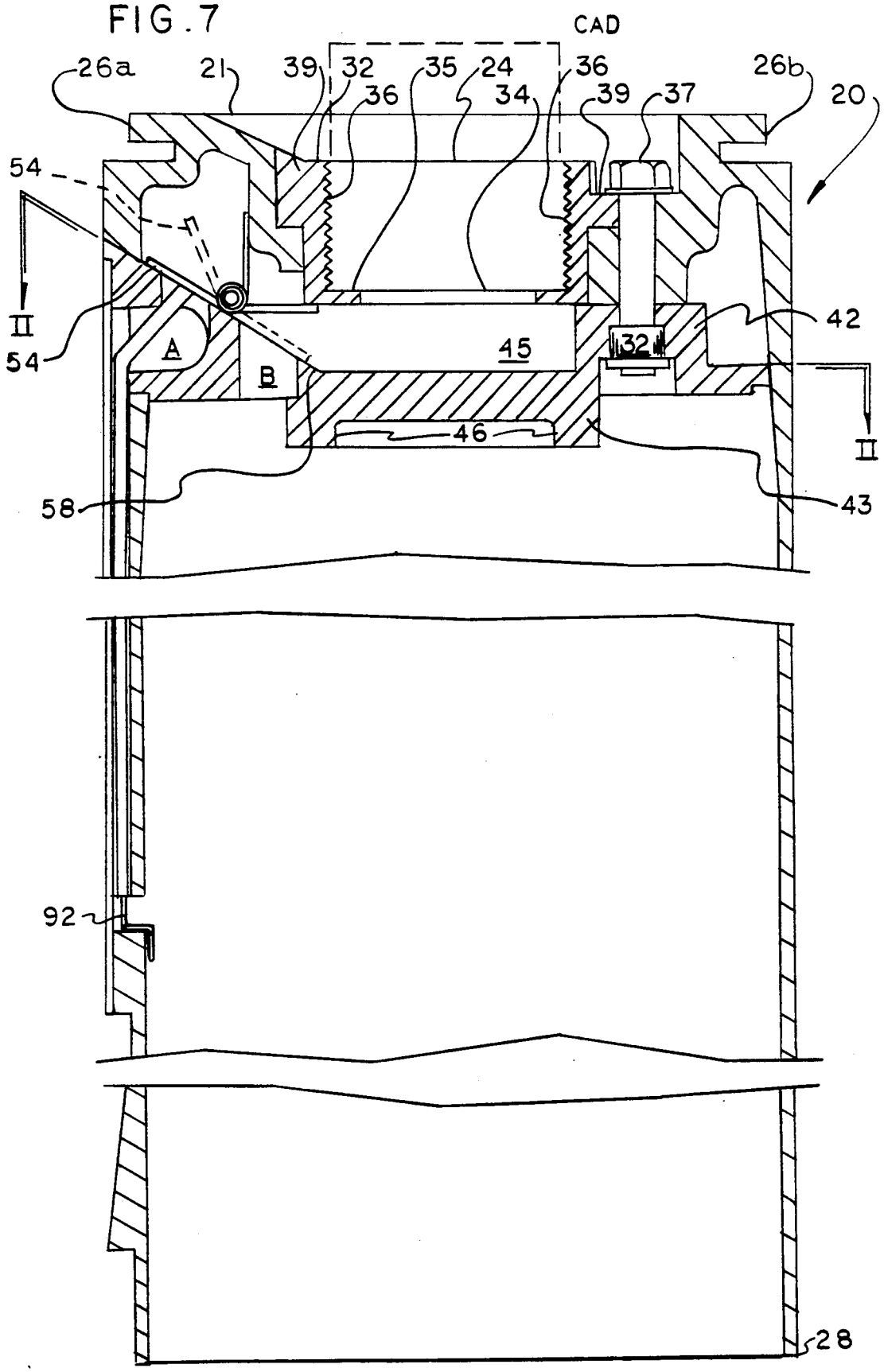
FIG. 7 shows a view similar to FIG. 6 depicting the resulting empty launch container after all stores have been ejected.

The action and reaction of the multi-store launch container can be more easily understood with reference to FIG. 1, 6 and 7. Launch container 20 is loaded with first store 22*b* and then store 22*a*. As probe 92 impacts upon rim 23*a*, it is forced toward the breach end of container 20 and that reaction moves it to a cocked position, as seen in solid line detail in FIGS. 1 and 5. Cable 84*b*, being rigidly connected to probe 92 and restricted in its lateral range of movement by tube 88, will, in turn, advance toward the breach end, thereby compressing spring 86 until the end of cable 84*b* contacts the end of cable 84*a*. Further movement of probe 92, and cable 84*b*, will now start moving cable 84*a*, which is also constrained in any lateral direction by tube 88, and which, in turn, now forces plunger 94 out of tube 88 against section half 54. The proximal end of tube 88 lies in a plane a very small, predetermined, distance, inside port A, below the completely closed plane created by section half 54 when valve 52 is first installed. The remaining movement of probe 92, cable halves 84*b*, 84*a* and plunger 94 forces section half 54 into the fully cocked position (as seen in FIG. 1) and forces section half 58 down, through the pivotal movement at bar 61, over port B. Port A is open to any fluid, such as compressed gas, charge and port B is completely closed.

When the first charge (as depicted by the dashed arrows) enters plenum chamber 32 and then colllection chamber 45, it is free to only proceed into the space immediately above section half 54 and, then, through port A and down the cavity. The charge will be forced through aperture 93 and around the perimeter of store 22*a*. The pressure from the charge will build until it is sufficient to overcome shear tabs (not shown) that are holding store 22*a* inside container 20. Store 22*a* will leave container 20 (as shown by the arrows at the lower end thereof depicting movement), and the force exerted by rim 23*a* against probe 92 will be removed. Now the stored u spring force in spring 86 will cause cable 84*a* to expand, thereby relieving the force against the end of cable 84*b*. This, in turn, will allow the upper end of cable 84*b*, and plunger 94, to be moved by the force generated by the overpowering spring force from spring extensions 65*a,b* against section half 54. The force from negator spring 63*a,b* will overcome the resistance of mechanism 80 and force section half 54 to completely close and seal port A, thereby completely opening port B, as seen in FIG. 6. As a design preference, port B can be made a predetermined amount larger in volume than port A. Now that port B is open, and port A is closed, a subsequent charge (as seen by the dashed arrows in FIG. 6) will flow through plenum chamber 32, into chamber 45 and out through port B. This charge will be diverted, once it reaches the inner surface of store 22*b*, by ring 46 to flow over the surface of the perimeter of store 22*b*. Once sufficient pressure, to overcome shear tabs (not shown) constraining store 22*b* inside container 20, builds up, the tabs will be broken and store 22*b* will be ejected. The empty launch container 20 is shown in FIG. 7.

Obviously, other embodiments and modifications of the present invention will readily come to those of ordinary skill in the art having the benefit of the teachings presented in the foregoing description and drawings. It is therefore to be understood that various changes in the details, materials, steps, and arrangements of parts, which have been described and illustrated to explain the nature of the invention, may be made by those skilled in the art within the principle and scope of the invention as expressed in the appended claims.

What I claim is:

1. A fluid-activated launcher system, connected to receive fluid charges, for sequentially ejecting stores releasably held in tandem position in a launch container, comprising:

a. a launch tube, having a breach end and a discharge end, loaded with a plurality of stores for ejection through the discharge end;

b. fluid producing means connected to said breach end to produce predetermined charges of fluid into said launch tube;

c. channel means connected to said fluid producing means to selectively divert the fluid charges to impact, sequentially, said plurality of stores;

d. a spring-biased flapper valve adjacent said channel means; and e. cocking means between at least one of the stores and said flapper valve to force said valve into an initial, cocked position prior to the ejection of the first of the stores.

2. A launcher system as described in claim 1 wherein said cocking means comprises:

a means for sensing the upper surface of one of said stores as it is being loaded into said tube, said means being located along the inner surface of said tube;

force-transferring means located inside a cavity adjacent the outside of the container and connected to said sensing means;

biasing means connected to said force transferring means; and plunger means connected to said force transferring means and said biasing means to regulate movement of said flapper valve.

3. A launcher system as described in claim 2 wherein said biasing means is a spring.

4. A launcher system as described in claim 3 wherein said means for sensing includes a solid, elongated probe extending through an aperture in the side of said container.

5. A launcher system as described in claim 4 wherein said force-transferring means includes a pair of cables, joined at adjacent ends by a said biasing means.

6. A launcher system as described in claim 5 wherein said plunger means includes an extension tip from one of said cable sections.

7. A launcher system as described in claim 1 wherein said channel means comprises a plurality of charge-diverting ports, each said port connected to a separate passage, to channel said charge to a first store and then to subsequent stores and a port cover means to alternately cover individual ports.

8. A launch container and mechanism for sequentially dispensing a plurality of stores, held therein in tandem positions, comprising:

a. a housing for carrying a plurality stores stacked in tandem arrangement, said housing having a first, breach end arranged to be joined to a fluid charge producing device and an oppositely disposed and open ejection end for releasing stores to the environment;

b. a plurality of passages, each leading from said breach end to a single store;

c. a multi-seated valve arranged adjacent said plurality of passages to reciprocatingly sealingly cover first one of said passages and then open said one passage and cover another said passage; and d. a spring-loaded plunger riding in said one passageway connected to one of said stores to contact said valve as the store is loaded.

* * * * *